US006256813B1

(12) United States Patent
Aaron

(10) Patent No.: US 6,256,813 B1
(45) Date of Patent: Jul. 10, 2001

(54) CRIB

(76) Inventor: A. Glenn Aaron, 3226 Quitman, Denver, CO (US) 80212

( * ) Notice: Subject to any disclaimer, the term of this patent is extended or adjusted under 35 U.S.C. 154(b) by 0 days.

(21) Appl. No.: 09/425,125

(22) Filed: Oct. 22, 1999

Related U.S. Application Data

(60) Provisional application No. 60/105,398, filed on Oct. 23, 1998.

(51) Int. Cl.[7] ..... A47D 7/00

(52) U.S. Cl. ..... 5/93.1; 5/98.1; 5/100; 5/186.1; 5/724

(58) Field of Search ..... 5/93.1, 93.2, 98.1, 5/100, 186.1, 724

(56) References Cited

U.S. PATENT DOCUMENTS

| | | | | |
|---|---|---|---|---|
| 2,566,594 | * | 9/1951 | Brown | 5/98.1 |
| 3,093,838 | * | 6/1963 | Beasley | 5/100 |
| 3,165,760 | * | 1/1965 | Abajian | 5/98.1 X |
| 5,555,577 | * | 9/1996 | Volpe | 5/93.1 |
| 5,561,876 | * | 10/1996 | Petruzella | 5/724 |
| 5,566,407 | * | 10/1996 | Lien | 5/93.1 |
| 5,699,571 | * | 12/1997 | Yowell | 5/724 |
| 6,055,690 | * | 5/2000 | Koenig | 5/724 |

OTHER PUBLICATIONS

Kid Safe Internet Webpage at www.kidsafeprod.com; 8 pages; Aug. 27, 1998.

* cited by examiner

*Primary Examiner*—Michael F. Trettel
(74) *Attorney, Agent, or Firm*—Dorsey & Whitney LLP

(57) ABSTRACT

A crib having a mesh sleeping surface, front and back sections, and a pair of end sections. In order to facilitate breathing of an infant when placed in the crib, the interior of the crib is formed of a breathable mesh material through which air can pass. The front section, positioned along a front side of the sleeping surface, has at least a portion of its interior surface formed of mesh. The front section can be either a "high/tall" front side, or a "low" front side, depending on the desired use of the crib. The back section, positioned along a back side of the sleeping surface, has at least a portion of an interior surface formed of mesh; and the pair of end sections, each positioned along an end of the sleeping surface, have a portion of an interior surface formed of mesh. The crib is configurable into four different configurations: a crib with the sleeping surface in a high position above the ground, with a tall front side; a youth couch with the sleeping surface in a high position above the ground, with a low front side; a crib or playpen with the sleeping surface in a low position proximate the ground, with a tall front side; and with the sleeping surface in a low position proximate the ground, and with a low front side, a fourth configuration is formed.

13 Claims, 9 Drawing Sheets

26
40

22
40

50
50
40
32

24
42
40
42

28
40

CRIB

This application claims priority from U.S. Provisional Patent Application, Serial No. 60/105,398 filed Oct. 23, 1998, and hereby expressly incorporates by reference all of the subject matter disclosed therein.

BACKGROUND OF THE INVENTION

Factors which may affect the overall safety of an infant in a crib include the height of the crib measured from the ground surface in the event that the baby falls from the crib; mechanical or structural failures (i.e., if a structural member in the crib should fail, the infant may fall from the crib or otherwise be injured); positional asphyxiation wherein the infant may suffocate if positioned in an area of the crib where breathing is difficult; suffocation between components if the infant should become caught between the components of the side rails of a crib; a child climbing on top of bumper pads within the crib may escape from the confines of the crib, which may result in injury to the child; a child may become trapped between the mattress and the mattress support and sustain injuries; and allergic reactions may arise if latex materials are used.

It is against this background that embodiments of the present invention were developed.

SUMMARY OF THE INVENTION

In light of the above, and according to a broad aspect of the invention, disclosed herein is a crib including a mesh sleeping surface, front and back sections, and a pair of end sections.

In order to facilitate breathing of an infant when placed in the crib, the interior of the crib is formed of a breathable mesh material through which air can pass. The front section, positioned along a front side of the sleeping surface, has at least a portion of its interior surface formed of mesh. The front section can be either a "high/tall" front side, or a "low" front side, depending on the desired use of the crib. The back section, positioned along a back side of the sleeping surface, has at least a portion of an interior surface formed of mesh; and the pair of end sections, each positioned along an end of the sleeping surface, have a portion of an interior surface formed of mesh.

The crib is configurable into four different configurations: a crib with the sleeping surface in a high position above the ground, with a tall front side; a youth couch with the sleeping surface in a high position above the ground, with a low front side; a crib or playpen with the sleeping surface in a low position proximate the ground, with a tall front side; and with the sleeping surface in a low position proximate the ground, and with a low front side, a fourth configuration is formed.

The foregoing and other features, utilities and advantages of the invention will be apparent from the following more particular description of a preferred embodiment of the invention as illustrated in the accompanying drawings and claims.

BRIEF DESCRIPTION OF THE DRAWING

FIG. 2 illustrates the sleeping surface with a mesh affixed thereto to form the sleeping surface.

FIGS. 3 and 4 illustrate a set of end sections, each end section having a set of support members, rotatably mounted about a pin, for supporting the sleeping surface.

FIGS. 5 and 6 illustrate the side sections of the crib wherein FIG. 5 illustrates a tall/high front side section and FIG. 6 illustrates the back side section.

FIG. 7 illustrates a low front side section which can be used in conjunction with the crib of FIG. 1 in one of the modes of the invention.

FIGS. 12 and 13 illustrate an inventive method for attaching the mesh to the frame structures wherein FIG. 12 illustrates the initial securement of the mesh to a first end of the structure using a weld, and FIG. 13 illustrates the final securement of the mesh to a second end of the structure using a weld.

DETAILED DESCRIPTION OF THE PREFERRED EMBODIMENT

Figure 1:
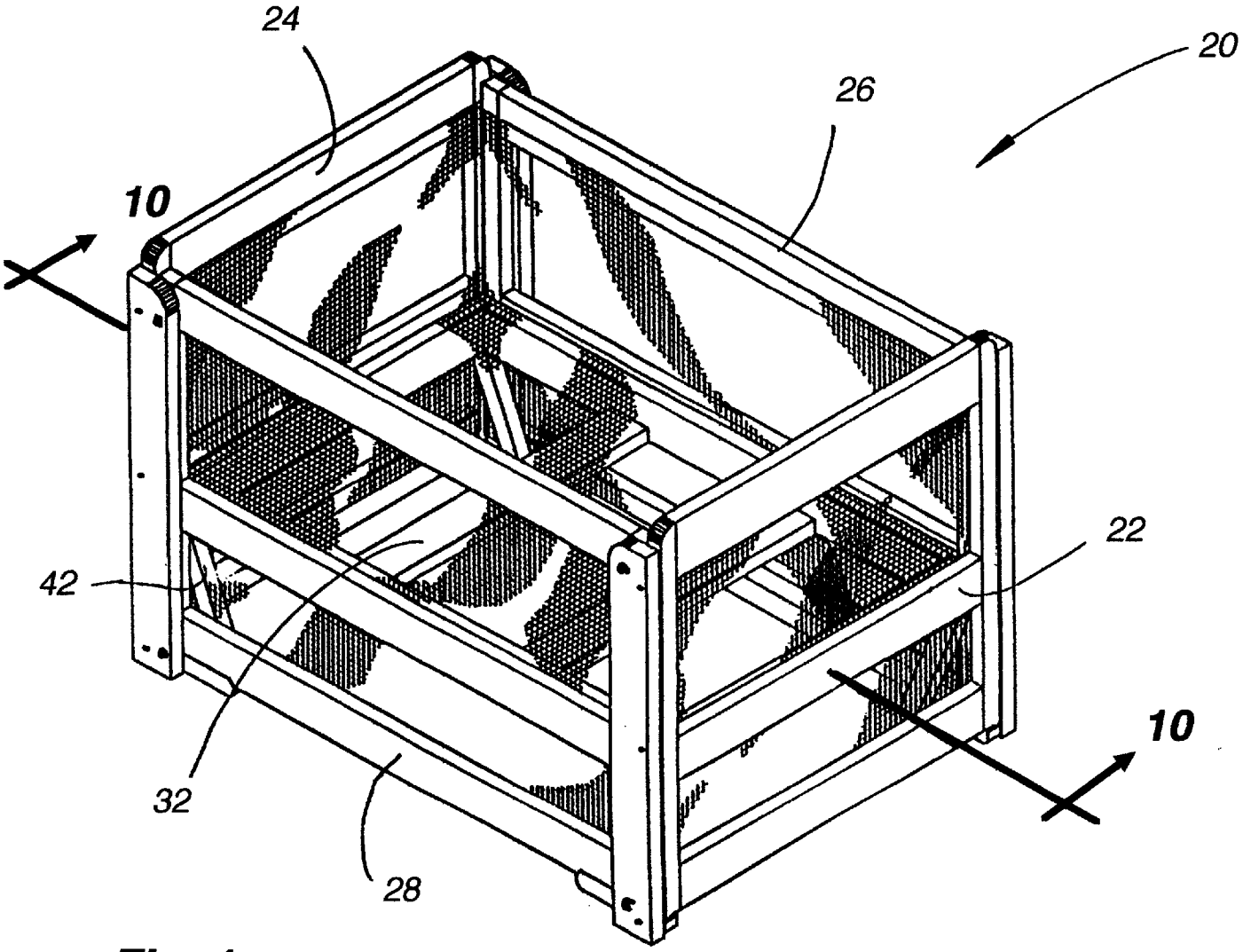
FIG. 1 illustrates a perspective view of the crib, in a first configuration with a tall/high front side and the sleeping surface in a high position.

In accordance with the present invention, a crib having a mesh interior surface and which can convert or be reconfigured into four different configurations is disclosed. The crib comprises a plurality of frame sections formed with the use of a mesh or screen material, which facilitates breathing of the infant when placed in the crib. The crib is ideally suited for use with infants and toddlers.

Referring to FIG. 1 and FIGS. 2–6, a crib 20 is shown which converts to an infant's settle or couch as will be described later. The crib 20 has five major structural components including two end sections 22, 24, a back side section 26, a front side section (either tall 28 or short 30), and a sleeping surface 32. The sleeping surface structure 32 in FIG. 2 can be used as a sleeping surface without the need for a mattress, although a mattress can be provided on top of the sleeping surface structure 32 if desired.

Figure 8:
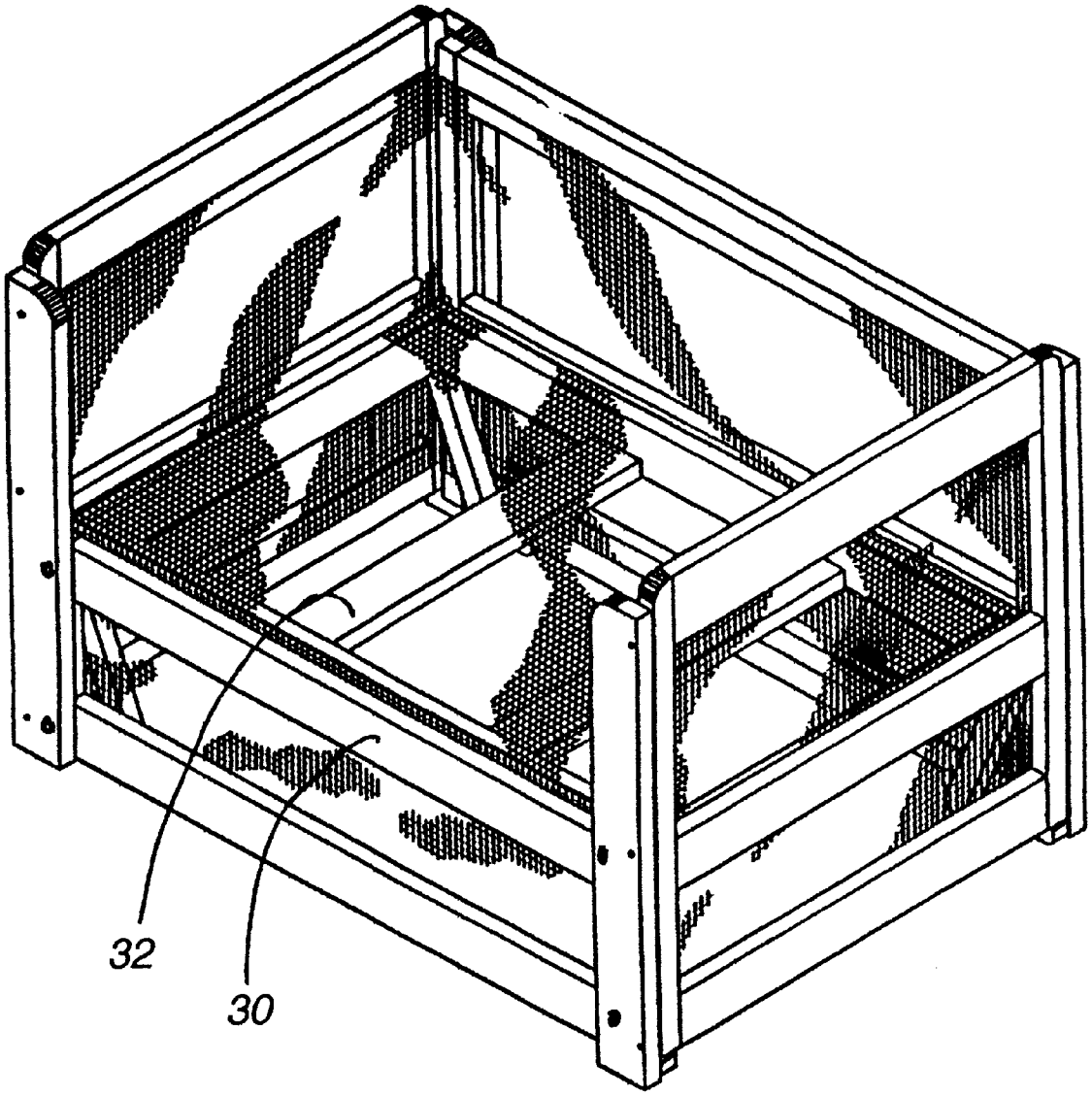
FIG. 8 illustrates the crib of the present invention in a second configuration, having a low front side section and the sleeping surface a high position.
Figure 9:
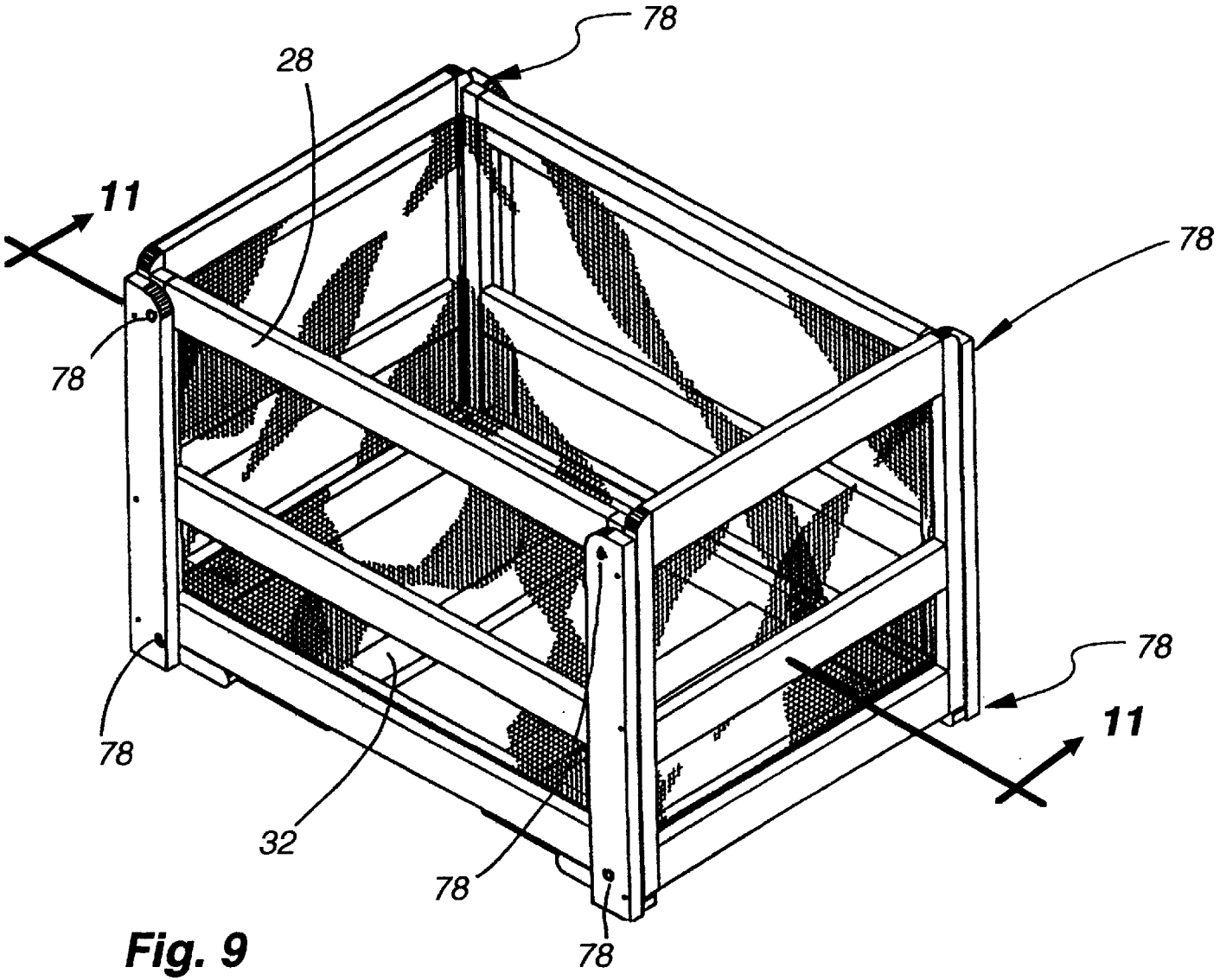
FIG. 9 illustrates the crib of the present invention in a third configuration, having the tall/high front side section and the sleeping surface in a low position.

All sections are formed using wood, or other like structurally sound materials, with a mesh or screen material 40 attached to the sections so that the material is positioned to form an interior surface of the crib as shown in FIGS. 1, 8 and 9. In one example, the mesh 40 is preferably a standard mesh phifertex, non-FR vinyl material of plain weave, capable of supporting at least 300 lbs before breaking, and being flame resistant, available from Phifer Wire Products, Inc. The mesh should also be selected to have a weave pattern so as to permit sufficient oxygen flow for breathing through the weaves of mesh material.

By the use of the mesh 40, a small infant wearing proper sleeping clothing can be placed directly on the sleeping surface 32 without the need for a mattress or blanket. In the event that the infant moves or turns over while sleeping, the risk of positional asphyxiation within the crib is reduced since the mesh interior permits oxygen flow therethrough. This effect is further enhanced since the interior of the crib is formed with an interior mesh surface along its end section 22,24, front side section 28/30, and back side section 26.

Figure 10:
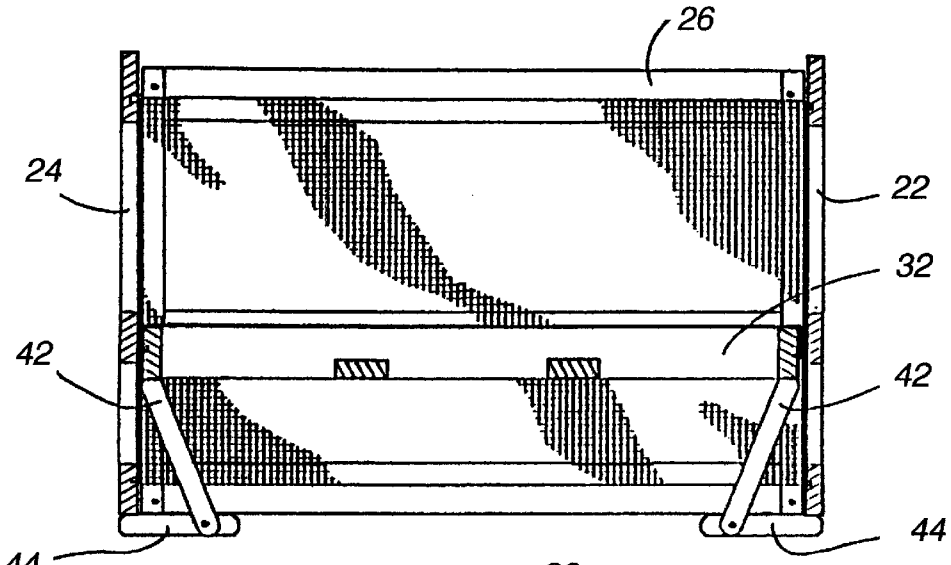
FIG. 10 is a sectional view taken along section lines 10—10 of FIG. 1 illustrating the back side section and the sleeping surface in a high position as supported by the support members.
Figure 11:
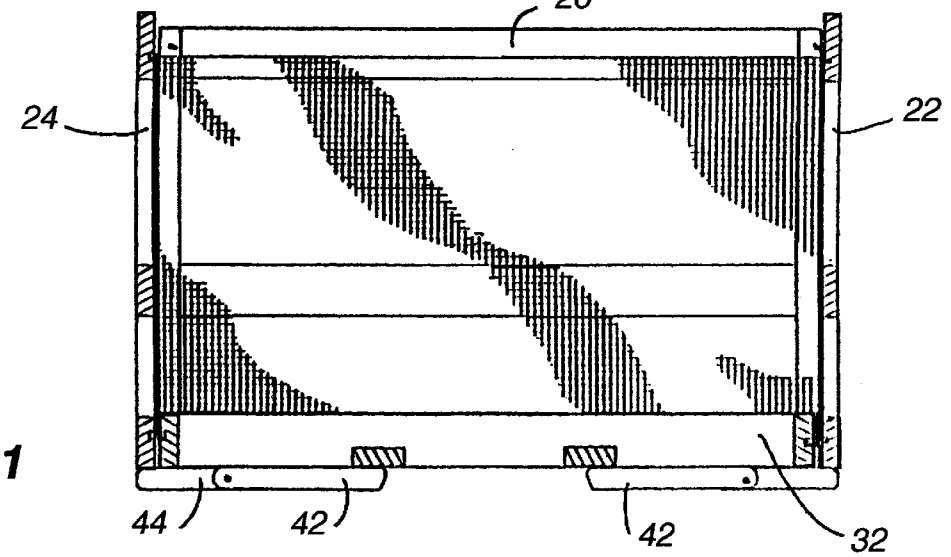
FIG. 11 illustrates a sectional view taken along section lines 11—11 of FIG. 9 illustrating the back side section with the sleeping surface in the low position resting upon the support members in their respective low positions.

The end sections 22, 24 are provided with a set of support members 42 rotatably mounted about the lower portion 44 of the end section so as to permit the sleeping surface 32 to be positioned either in a low position, as shown in FIGS. 9 and 11, or in a high position as shown in FIGS. 1, 8, and 10.

Figures 2, 3, 4, 5, 6:
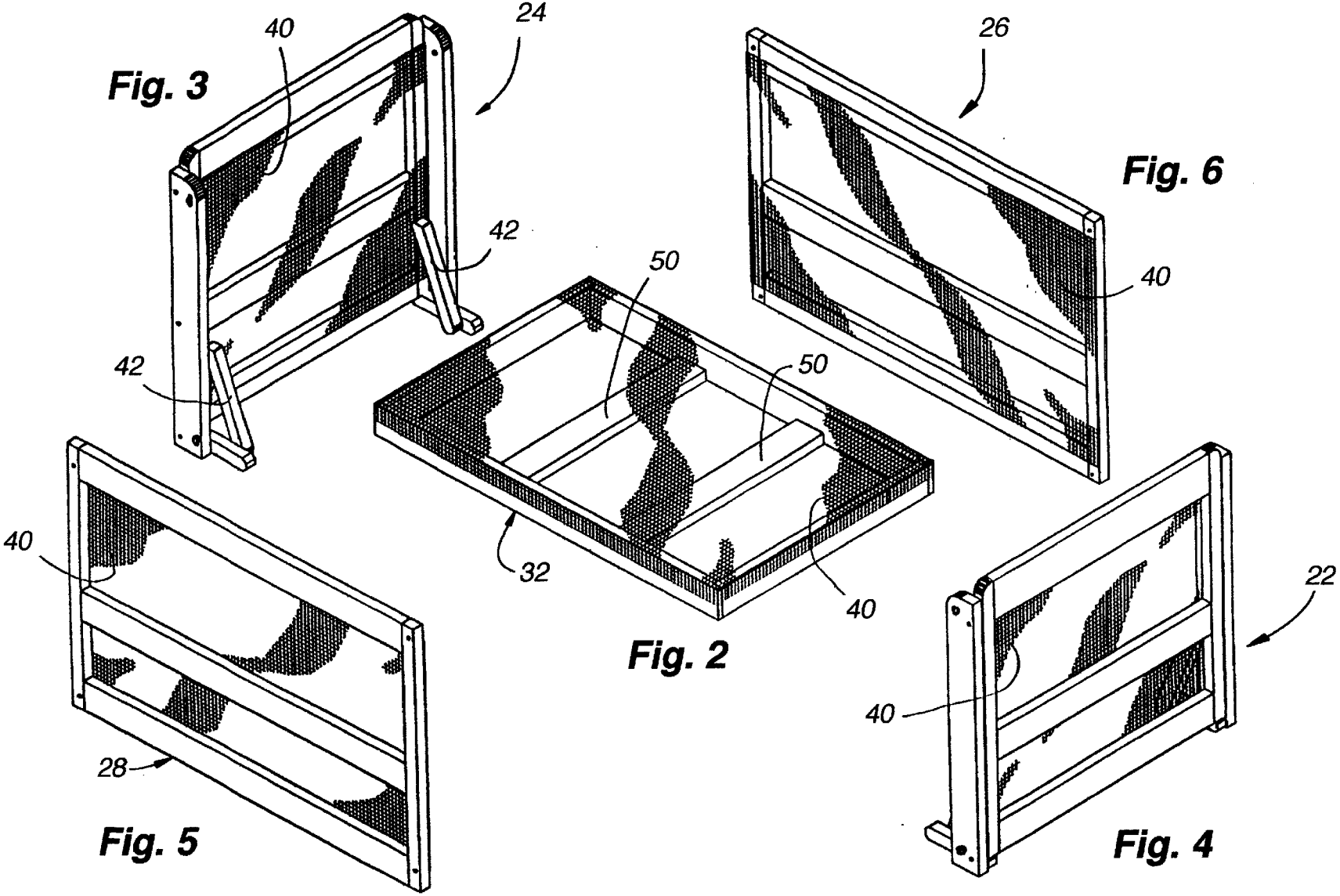
FIGS. 2–7 illustrate the various sectional components of the crib of FIG. 1.
Figure 7:
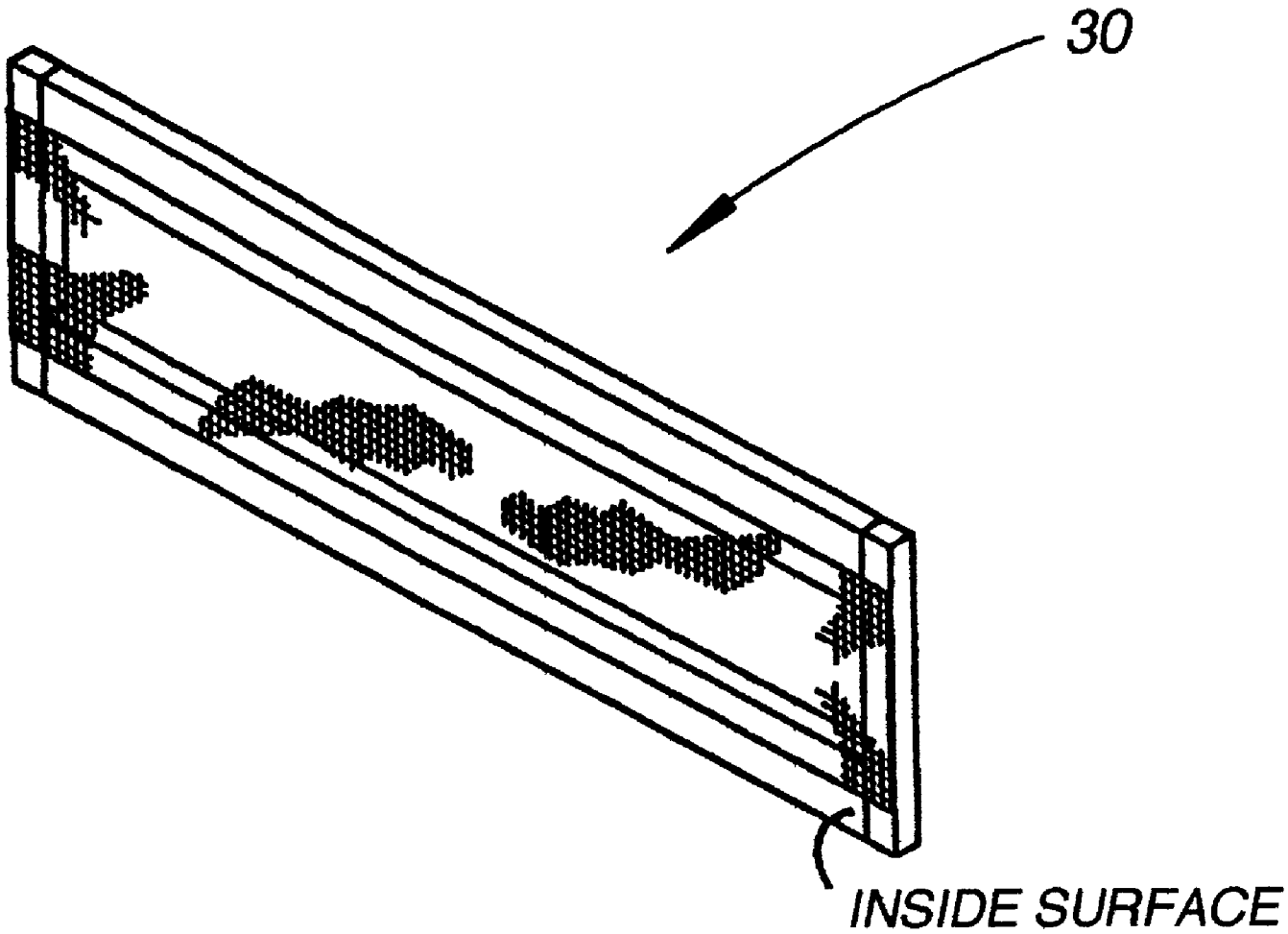

The front side section of the crib of the present invention can be either a tall/high front side 28 (as shown in FIG. 5), or a low front side 30 (as shown in FIG. 7), depending upon the mode in which the crib is to be used. Because the sleeping surface 32 can be placed in a low or high position, and a tall or low front side section can be used, there are four configurations of the crib which are available and easily interchanged.

In a first configuration, the sleeping surface 32 can be placed in a high position and used in conjunction with the tall/high front side section 28 as shown in FIG. 1. In this configuration, the high position of the sleeping surface assists a parent with the placement of the baby in the crib as the parent need not extend their reach the entire height of the crib. This configuration is preferably used with an infant not capable of standing.

In a second configuration, the sleeping surface 32 is placed in the high position and used in conjunction with a low front side section 30 as shown in FIG. 8. In this mode, the crib operates as a "settle" or couch, and is preferably used with older children over 35" in height, for example.

In a third configuration, the sleeping surface 32 is placed in the low position and used in conjunction with the tall/high front side 28, as shown in FIG. 9. In this configuration, the crib provides high walls about the sleeping surface, and is preferably used with infants capable of standing or easily moving about the crib. This configuration can also serve as a play pen. As shown in FIG. 9, since the sleeping surface 32 is positioned adjacent to and in close proximity to the ground, the risk of an injury from falling from the crib is reduced.

Figure 17:
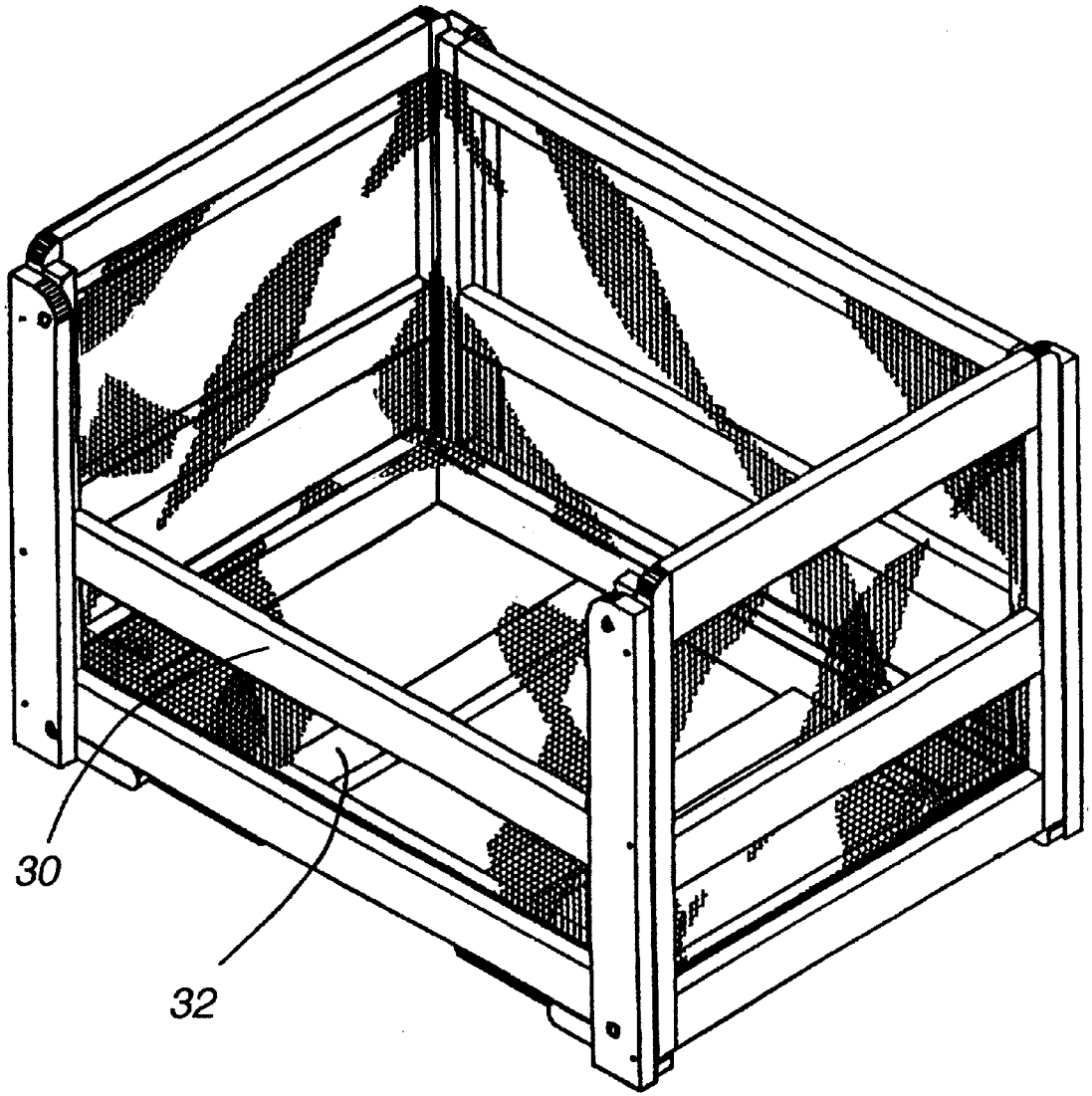
FIG. 17 illustrates the crib of the present invention in a fourth configuration, wherein the crib is configured with a low front side and the sleeping surface in low position.

In a fourth configuration (shown in FIG. 17), the crib can be used with the sleeping surface 32 in the low position in conjunction with a low front side 30. This configuration permits supervised interaction with the infant and is preferably used when the baby is not capable of standing.

Because of the interchangeable and re-configurable nature of the high front section 28 and the low front section 30, and the ease of which the sleeping surface 32 can be alternated between the high and low positions, the crib can easily be converted from one mode to another mode.

Referring to FIG. 2, in one example, because the frame structure of the sleeping surface 32 has two interior support members 50 positioned well below the mesh sleeping surface, the mesh screen 40 can deflect so as to biasly position the infant towards the center of the mesh. This assists in keeping the infant away from the corners or the edges of the crib during sleep. This extent to which the mesh deflects depends on the type of mesh used, the initial tension applied to the mesh, and the relative load crated by the infant on the mesh.

Figure 12:
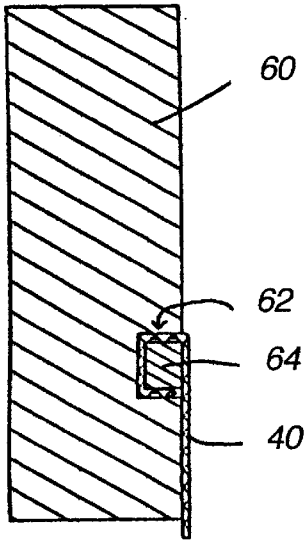
Figure 13:
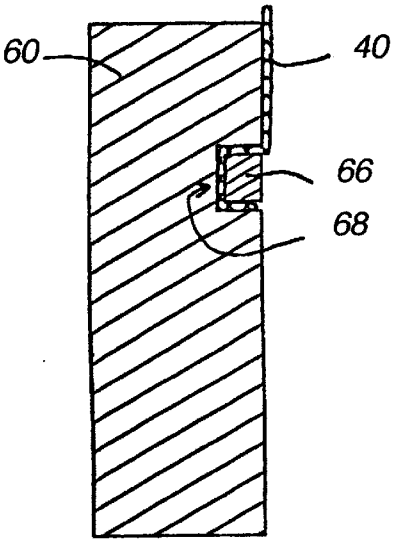

FIGS. 12 and 13 illustrate how the mesh 40 is attached to the structural component 60 of the crib in accordance with one example of the present invention. A slot 62 is cut along the structural member and the mesh 40 is placed within the slot as shown in FIG. 12. A weld 64, preferably made of durable plastic or other like material, is then inserted within the slot to secure the mesh within the slot. The mesh 40 is then extended about the interior surface of the structural member and extended over a second slot 68 of a second end the structural member at a desired tension. A second weld 66 for final securement is then positioned within the second slot 68 about the mesh to secure the mesh within the slot 68 as shown in FIG. 13, after the mesh is at the desired tension. In this manner, the mesh is securely affixed to the interior surface of the structural member and no screws or staples or other securement elements are exposed on the interior of the crib, thereby reducing the chance that the infant can detach the mesh or be injured by a staple or the like.

Staples can optionally be used for additional securement of the mesh and weld to a particular section of s structural member. Of course, other means can be used to secure the mesh to the particular section. It is beneficial to position any securing means in such a manner not to be exposed to the interior of the crib.

Figure 16:
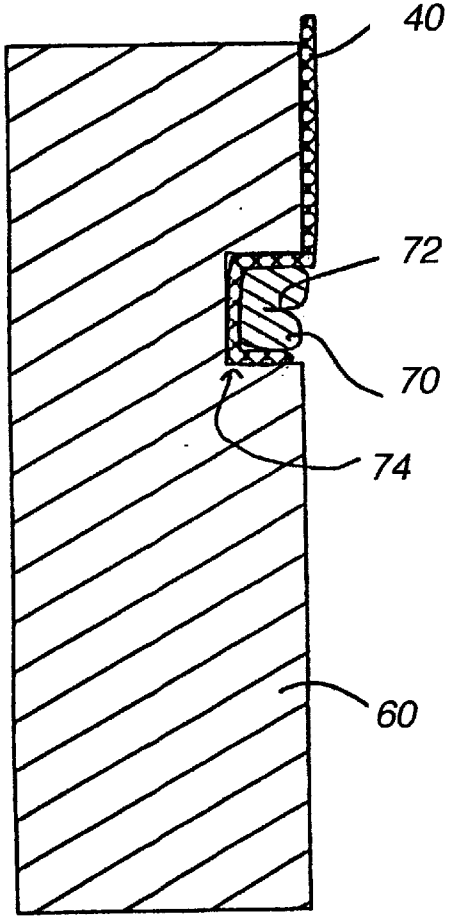
FIG. 16 illustrates a weld having a crease used to secure the mesh and weld into the slot of a section of the structure.

FIG. 16 shows one example of a weld 70 wherein the weld has a pre-formed crease 72 along its centerline which permits its insertion into the slot 74 using a flathead screwdriver (not shown), or other like device, by pressing the flat edge of the screwdriver along the crease 72 after the mesh has been placed within the slot under the weld 70.

Due to the tension applied to the mesh and maintained by the slots and the welds, the mesh can in fact reinforce the frame on which the mesh is placed, thereby improving the structural integrity of the section to which the mesh is secured about.

Figure 14:
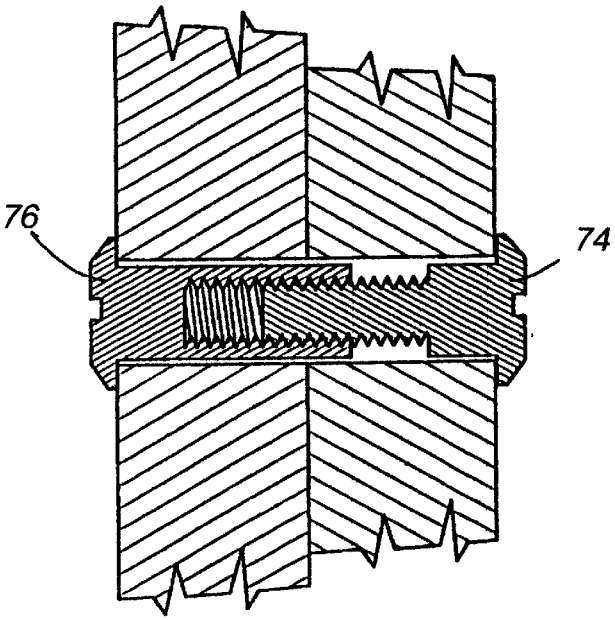
FIG. 14 illustrates a connector bolt and cap for connecting the side sections of the crib to the end sections of the crib of the present invention.

Referring to FIG. 14, in one example the side sections 70 (i.e., sections 26, 28 or 30) are connected to the end sections 72 (i.e., sections 22 or 24) using a connector bolt 74 and cap 76. These components are readily available at hardware stores and the like, and permit easy and simple connections between the side sections and the end sections. The connector bolt and cap can be used in eight places 78 throughout the crib as shown in FIG. 9.

Figure 15:
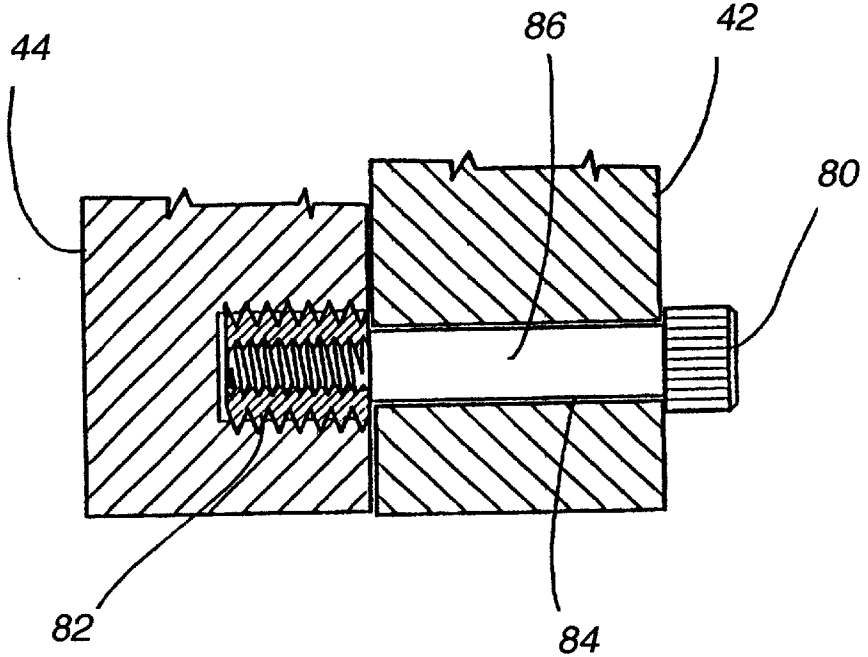
FIG. 15 illustrates a shoulder bolt and a threaded insert for coupling a support member to an end section.

Referring to FIG. 15, in one example of the present invention, a shoulder bolt 80 and self-threading insert 82 are used in combination to secure each support member 42 to a lower portion 44 of an end section and permits the support member to rotate about the bearing surface 84 formed on the shaft 86 of the shoulder bolt 80.

The dimensions of the crib and associated sections can be varied in design according to the desired uses and applications of the crib. In one preferable example, the crib is 27 inches high along the end sections 22, 24 and tall side section 26, with the low side section 30 being 12 inches high. The low position of the sleeping surface 32 is approximately 3 inches off of the ground surface, while the high position of the sleeping surface is approximately 12 inches from the ground surface. These exemplary dimensions of the crib are by way of example only.

Because the interior surface of the crib is made of the mesh material throughout, there are no components between which an infant can become caught and possibly injured between. Further, the risk that an infant will suffocate when facing the mesh sleeping surface is reduced due to the breathability of the mesh surface. Since the present invention provides a sleeping surface which is preferably used without a mattress, a child will not become trapped between the mattress and the mattress support and sustain injuries. Finally, since the sleeping surface can be positioned proximate the ground, the risk of serious injury from an infant falling out of the crib is reduced.

Further, because of the independent nature of each of the sections, the crib is easily assembled or dismantled, thereby permitting the crib to be easily stored and shipped if needed.

While the invention has been particularly shown and described with reference to a preferred embodiment thereof, it will be understood by those skilled in the art that various other changes in the form and details may be made without departing from the spirit and scope of the invention.

What is claimed is:

1. A reconfigurable crib, comprising:

a mesh sleeping surface positionable proximate the ground;

a front section, positioned along a front side of the sleeping surface, having an interior surface formed of mesh;

a back section, positioned along a back side of the sleeping surface, having an interior surface formed of mesh; and a pair of end sections, each positioned along an end of the sleeping surface, having an interior surface formed of mesh;

wherein said pair of end sections each have a pair of support members rotatably mounted on a lower portion of said end section, said support members rotatable into an upwardly oriented position for supporting said sleeping surface in a high position.

2. The reconfigurable crib of claim 1, wherein said front section has a height of approximately a distance from the ground to the sleeping surface, thereby the sleeping surface, front and back sections, and pair of end sections forming a couch.

3. The reconfigurable crib of claim 1, wherein said front section has a height of approximately a height of the end sections, thereby the sleeping surface, front and back sections, and pair of end sections forming a crib or playpen.

4. The reconfigurable crib of claim 1, wherein said front section has a height of approximately one-third a height of the end sections, and said sleeping surface is positionable proximate the ground.

5. The reconfigurable crib of claim 1, wherein said mesh is a phifertex material.

6. A crib, comprising:

a mesh sleeping surface;

a front section, positioned along a front side of the sleeping surface, having a portion of an interior surface formed of mesh;

a back section, positioned along a back side of the sleeping surface, having a portion of an interior surface formed of mesh; and a pair of end sections, each positioned along an end of the sleeping surface, having a portion of an interior surface formed of mesh;

wherein said pair of end sections each have a pair of support members rotatably mounted on a lower portion of said end section, said support members rotatable into an upwardly oriented position for supporting said sleeping surface in a high position.

7. The crib of claim 6, wherein said front section has a height of approximately a distance from the ground to the sleeping surface, thereby the sleeping surface, front and back sections, and pair of end sections forming a couch.

8. The crib of claim 6, wherein said sleeping surface is positioned approximately 3 inches above the ground.

9. The crib of claim 6, wherein said front section has a height of approximately a height of the end sections, thereby the sleeping surface, front and back sections, and pair of end sections forming a crib or playpen.

10. The crib of claim 6, wherein said mesh is a phifertex material.

11. A reconfigurable crib, comprising:

a mesh sleeping surface positionable proximate the ground;

a front section, positioned along a front side of the sleeping surface, having an interior surface formed of mesh;

a back section, positioned along a back side of the sleeping surface, having an interior surface formed of mesh; and a pair of end sections, each positioned along an end of the sleeping surface, having an interior surface formed of mesh, wherein said front section has a height of approximately one-third a height of the end sections, and said sleeping surface is positionable proximate the ground.

12. The reconfigurable crib of claim 11, wherein said pair of end sections each have a pair of support members rotatably mounted on a lower portion of said end section, said support members rotatable into an upwardly oriented position for supporting said sleeping surface in a high position.

13. The reconfigurable crib of claim 11, wherein said mesh is a phifertex material.

* * * * *